US005088250A

United States Patent [19]

DeLong et al.

[11] Patent Number: 5,088,250

[45] Date of Patent: Feb. 18, 1992

[54] PANEL FOR AN OFFICE SPACE DIVIDING SYSTEM

[75] Inventors: Ronald B. DeLong, Belmont; Allen L. Palmbos, Jenison, both of Mich.

[73] Assignee: Westinghouse Electric Corp., Pittsburgh, Pa.

[21] Appl. No.: 640,742

[22] Filed: Jan. 14, 1991

[51] Int. Cl.[5] ..... E04B 1/62; E04B 1/343

[52] U.S. Cl. ..... 52/239; 52/400; 52/403; 52/397

[58] Field of Search ..... 49/488–491, 49/460, 440, 441, 397–403, 716, 202, 239, 243.1, 710, 239

[56] References Cited

U.S. PATENT DOCUMENTS

| | | | |
|---|---|---|---|
| 1,751,786 | 3/1930 | Best | 52/400 |
| 3,018,525 | 1/1962 | Deisenroth | 49/441 |
| 3,099,337 | 7/1963 | Hetman | 52/404 |
| 3,762,116 | 10/1973 | Anderson et al. | 52/239 |
| 4,092,813 | 6/1978 | Eggert | 52/716 |
| 4,105,814 | 8/1978 | Eggert | 52/716 |
| 4,599,836 | 7/1986 | Melcher | 52/202 |

FOREIGN PATENT DOCUMENTS

| | | | |
|---|---|---|---|
| 675016 | 7/1952 | United Kingdom | 52/243.1 |
| 1013217 | 12/1965 | United Kingdom | 52/710 |

*Primary Examiner*—James L. Ridgill, Jr.
*Attorney, Agent, or Firm*—D. R. Lackey

[57] ABSTRACT

A substantially rectangular panel suitable for use in an office space dividing system, with the panel including a frame constructed of rails and stiles. The rails and stiles define a window having inner facing edges which include channels for receiving a sheet of material. Glazing strips are provided for the channels which are configured such that they are insertable into a channel in a selected one of two orientations. In one orientation, the glazing strip is in a normal position to receive the sheet of material. In the other orientation the glazing strip is inverted, completely blocking access to the channel, to prevent foreign matter from entering the channel prior to assembly of the sheet of material with the frame.

7 Claims, 3 Drawing Sheets

PANEL FOR AN OFFICE SPACE DIVIDING SYSTEM

TECHNICAL FIELD

The invention relates generally to office space dividing systems, and more specifically to panels for such systems which have a sheet of material supported by a surrounding frame.

BACKGROUND ART

Office space dividing systems, such as the office space dividing system described in U.S. Pat. No. 3,762,116, often require one or more panels which include a translucent or transparent sheet of material. While such sheet material may be in the form of plastic or glass, it will be hereinafter referred to simply as "glass", in order to facilitate the description of the invention. Such a panel includes a metallic frame constructed of rails and stiles to form a window, with inner facing edges of the frame having channels which collectively define a continuous annular channel for receiving the perimetrical edges of the glass. Because of the weight of such panels, and the possibility of scratching, breaking, or otherwise damaging the glass, it is common to ship the frame and glass separately, for assembly at the job site. It is also common to sell panels or frames with no glass, so the user can add glass when desired, or add "customized" glass. The frames, however, collect dirt and debris in the channels, requiring a time consuming cleaning operation to prepare the channels for receiving the glass.

DISCLOSURE OF THE INVENTION

Briefly, the present invention makes it unnecessary to perform the channel cleaning process prior to assembly of the glass and frame by constructing glazing strips, which are normally inserted in the channels prior to glass assembly to cushion and protect the edges of the glass, to perform an additional function. The glazing strips are configured such that they are insertable into a channel in a selected one of two orientations. One orientation is the normal orientation which allows the edges of the glass to be received into the channels. The other orientation inverts the glazing strip, with reference to the normal orientation, with the unique configuration of the glazing strip resisting accidental dislodgement while completely protecting the channel from foreign matter. The dual purpose glazing strips are inserted into the channels at the factory, in their channel-protective orientation, and they are not removed until the frame is taken apart at the job site to place the edges of the glass in the channels formed in the frame elements. When a glazing strip is removed, it is immediately placed back in the channel from which it was taken, but in the glass-receiving orientation. Thus, in addition to protecting the channels from collecting dirt and debris, which eliminates a cleaning operation, glazing strips of the correct length are instantly available when needed at the time of assembly for use in the assembly operation.

BRIEF DESCRIPTION OF THE DRAWINGS

The invention may be better understood and further advantages and uses thereof more readily apparent when considered in view of the following detailed description of exemplary embodiments, taken with the accompanying drawings, in which.

DESCRIPTION OF PREFERRED EMBODIMENTS

Figure 1:
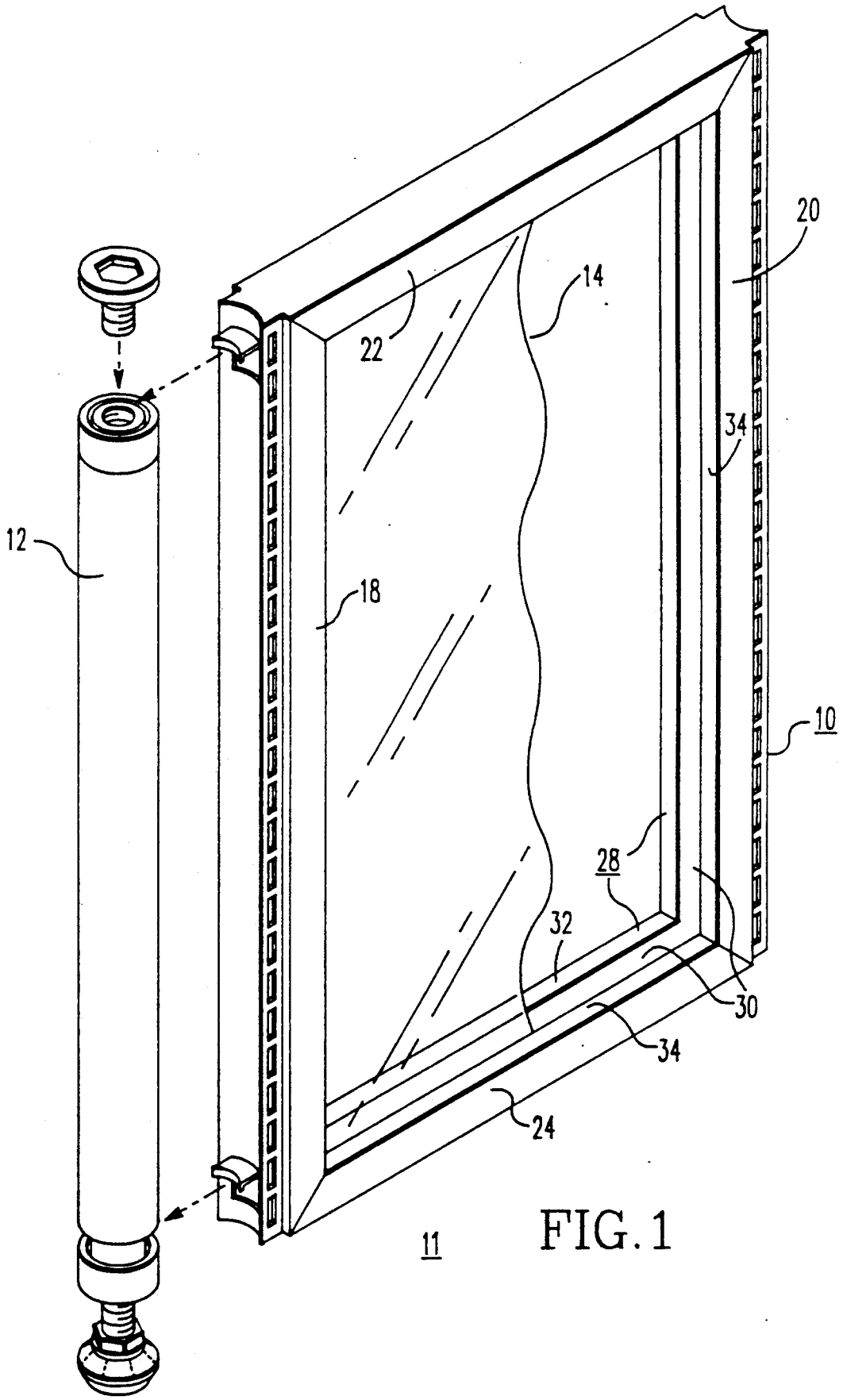
FIG. 1 is a partially exploded perspective view of a rectangular panel for an office space dividing system which may utilize the teachings of the invention.

Referring now to the drawings, and to FIG. 1 in particular, there is shown, in perspective, a rectangular panel 10 of an office space dividing system 11, such as described in the hereinbefore mentioned U.S. Pat. No. 3,762,116. Panel 10 may be supported by posts, such as post 12, or it may be directly connected to adjacent panels via clamps, hinges, or the like. Panel 10 is of the type which has a sheet 14 of translucent or transparent material, such as glass or plastic, supported by a metallic frame 16. Sheet 14, which has a predetermined thickness dimension, and is bounded by flat perimetrical edges, will be hereinafter be referred to as glass 14.

Metallic frame 16 is constructed of first and second upright stiles 18 and 20 and upper and lower rails 22 and 24 which are assembled to cooperatively define a window 26. Each of the rails and stiles have an inner facing edge which borders window 26, such as inner facing edges 28 of lower rail 24 and stile 20. Each of the inner facing edges 28 have a centrally disposed, longitudinally extending channel 30, and flat surfaces 32 and 34 on the two sides of channel 30.

Figure 2:
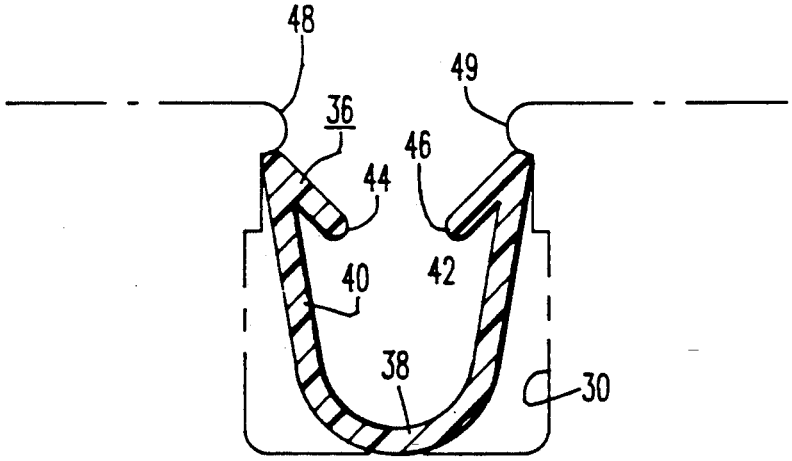
FIG. 2 PRIOR ART
FIG. 2 is a cross sectional view of a glazing strip constructed to the teachings of the prior art.

In the prior art it is common to ship frame 16 without the glass 14. Frame 16 is disassembled at the job site and prior art glazing strips, such as glazing strip 36 shown in FIG. 2, are inserted into channels 30 of the frame elements. Each glazing strip 36, which is formed of a suitable flexible plastic material, such as polyvinyl chloride, cushions and protects a perimetrical edge of glass 14, as well as functioning as an anti-rattle device. Glazing strip 36 is generally U-shaped in cross section, having a curved or rounded bight 38 and first and second substantially straight leg portions 40 and 42 which angle outwardly from bight 38. Barbs 44 and 46 are integrally formed at the extreme ends of leg portions 40 and 42, to engage the glass 14 when a perimetrical edge of glass 14 is inserted into the openings of channel 30 and glazing strip 36. Lip portions 48 and 49 are provided, which are spaced apart by a predetermined dimension at the mouth of channel 30. Lip portions 48 and 49 maintain glazing strip 36 within the channel, after the leg portions 40 and 42 are pressed toward one another and then released to press against the sides of channel 30. As hereinbefore stated, dirt and debris collects in channel 30 prior to assembly with glass 14, requiring that the channels 30 be cleaned in the field at the time of assembly.

Figure 3:
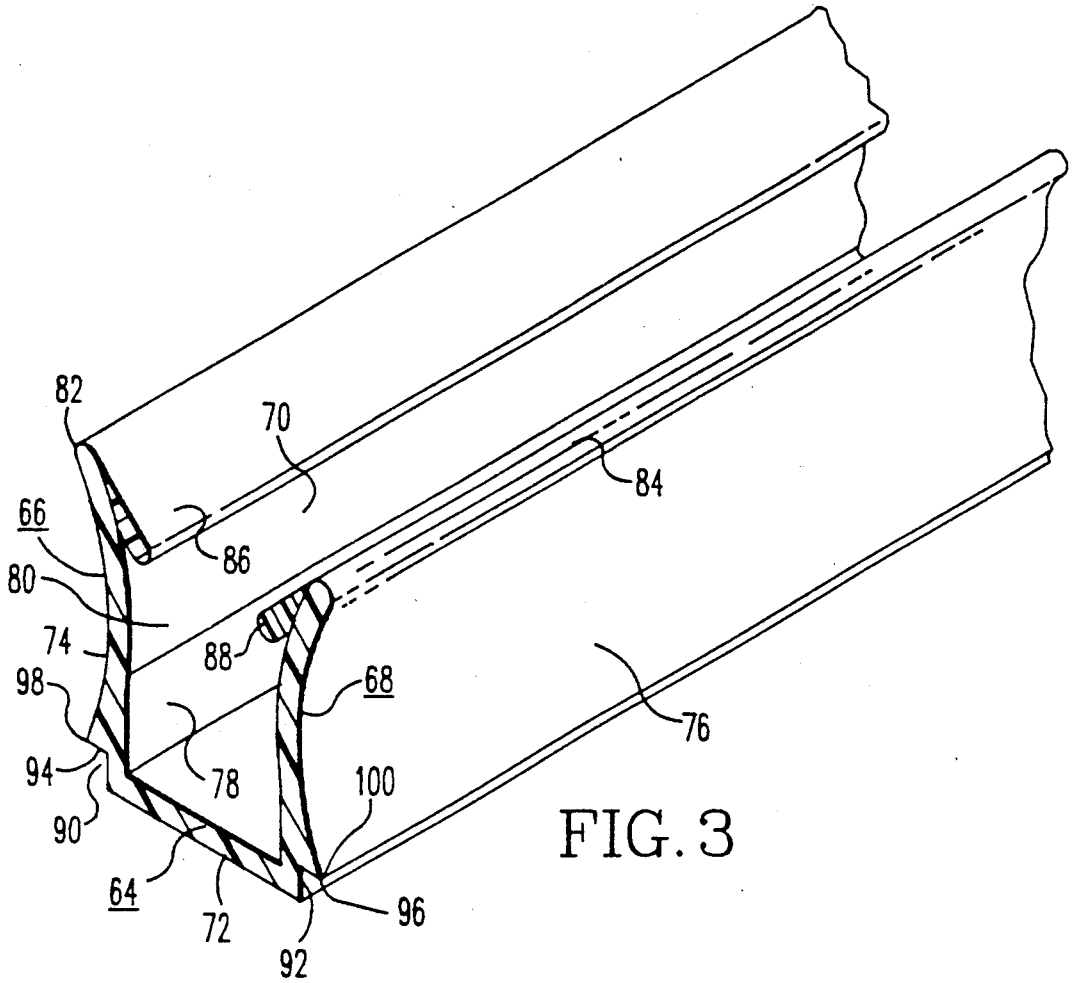
FIG. 3 is a perspective view of a glazing strip constructed to the teachings of the invention.

The present invention includes a new glazing strip 50 shown in perspective in FIG. 3. Glazing strip 50 is configured such that it may be used in the orientation shown in FIG. 4 to protect channel 30 from the entry of foreign matter from the time the associated frame element is assembled with other frame elements in a factory, to form frame 16, until the frame 16 is disassembled in the field and reassembled with glass 14, and also in the orientation shown in FIG. 5, to protect and cushion an edge 52 of glass 14.

Figure 4:
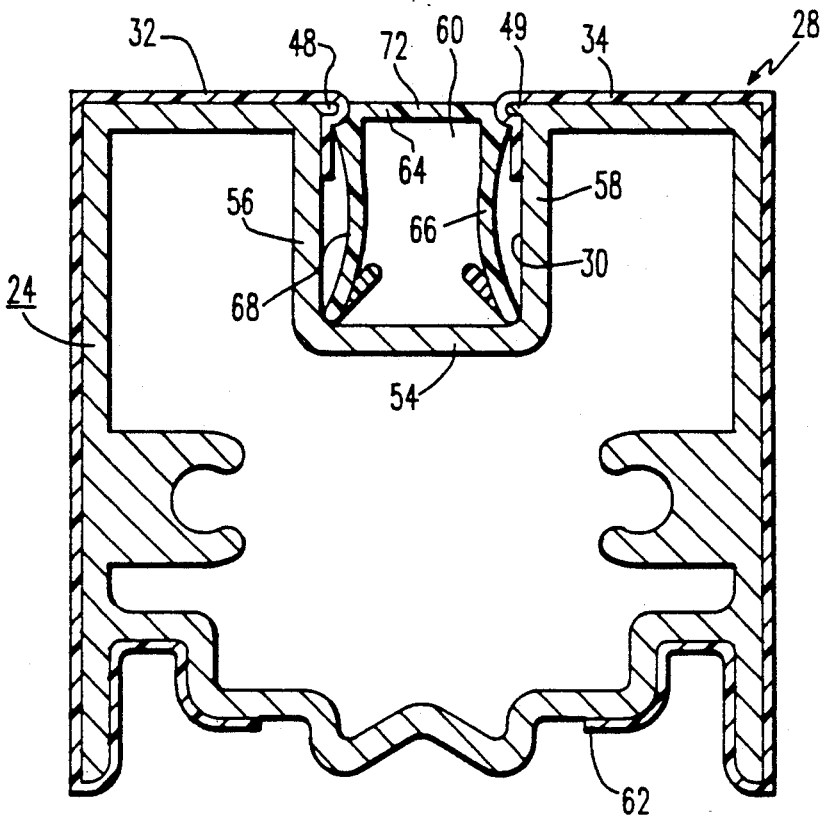
FIG. 4 is a cross sectional view of a frame element with the glazing strip of FIG. 3 inserted into an orientation which performs the function of completely protecting the channel from entry of foreign matter prior to assembly of the sheet of material with the frame elements.
Figure 5:
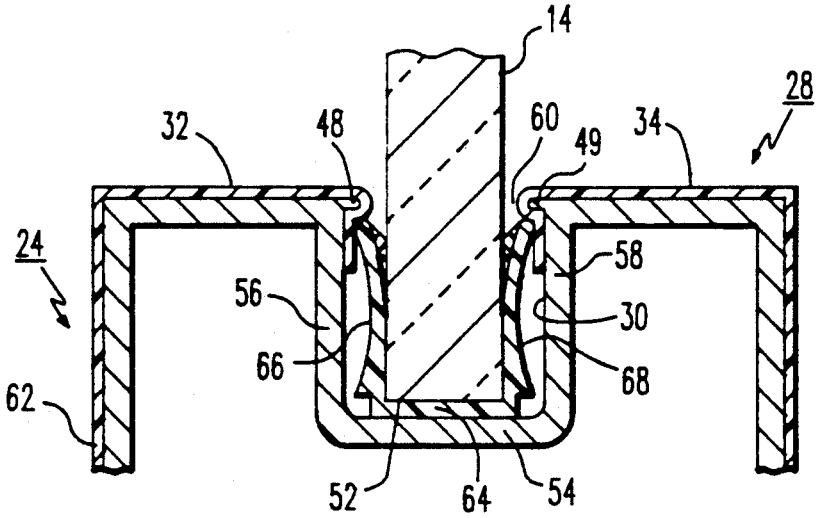
FIG. 5 is a cross sectional view of a frame element, similar to that of FIG. 4, except with the glazing strip of FIG. 3 inserted into a glazing channel in an orientation which performs the function of protecting the edge of a translucent or transparent sheet of material.

As shown in FIGS. 4 and 5, a frame element, such as lower rail 24, for example, has the hereinbefore mentioned channel 30. Channel 30 is substantially U-shaped in cross section, having a flat bight 54, and first and second leg portions 56 and 58 which define an opening 60 to the channel. The hereinbefore mentioned lip portions 48 and 49, which are continuations of flat surfaces 32 and 34, extend slightly into opening 60 to reduce the initial width thereof. As illustrated in FIGS. 4 and 5, each frame element may be covered with a decorative layer 62, such as a tightly wrapped decorative fabric covering.

Glazing strip 50 is substantially U-shaped in cross section, having a bight 64 and first and second spaced leg portions 66 and 68 which define an opening 70. Unlike the prior art glazing strip 36, bight 64 is not curved, but flat, having a flat outer surface 72. Legs 66 and 68, instead of being straight, are bowed, flaring outwardly from bight 64 such that, when unstressed, they extend beyond the width dimension of bight 64, and the dimension between their extreme ends exceeds the dimension between lip portions 48 and 49. The outer sides or surfaces 74 and 76 of leg portions 66 and 68, when viewed in section, may have the configuration of a segment of a circle having a predetermined radius. Each inner side or surface of leg portion 66 and 68, such as leg portion 66, includes a flat portion 78 which rises perpendicular to bight 64, and a curved portion 80 which is in spaced relation with the outer curved portion 74 to provide a substantially uniform thickness dimension to leg 66.

The extreme ends 82 and 84 of leg portions 66 and 68 have inwardly directed barbs 86 and 88. Instead of forming barbs 86 and 88 from the same material as leg portions 66 and 68 and bight 64, as in the prior art glazing strip 36, barbs 86 and 88 are formed of a softer durometer plastic. For example, the leg portions 66 and 68 and bight 64 may be formed of a rigid but flexible, non-brittle polyvinyl chloride, while barbs 86 and 88 may be formed from a softer, more resilient polyvinyl chloride. Barbs 86 and 88 may be co-extruded with glazing strip 50, as is well known in the art.

Glazing strip 50 has notches 90 and 92 formed therein at outer corners thereof, at the intersection of leg portions 66 and 68 with bight 64. Notches 90 and 92 form flat surfaces 94 and 96 which are spaced from, and parallel to, outer flat surface 72 of bight 64.

As shown in FIG. 4, when the frame 16 is assembled at a factory, a glazing strip 50 of proper length is snapped into each channel 30. The leg portions 66 and 68 are flexed inwardly to enable glazing strip 50 to enter the channel opening 70. Dimensions of the glazing strip 50 and the spacing between lip portions 48 and 49 are selected to provide a slight interference fit which enables outer corners 98 and 100 adjacent to the notches 90 and 92 to be forced past the lip portions 49 and 48. The flat surfaces 94 and 96 of notches 90 and 92 now lie under the lips 49 and 48, securing glazing strip 50 within channel 30. The flat outer surface 72 of bight 64 extends completely across the mouth of channel 30, aligned with, or in substantially the same plane as, the flat surfaces 32 and 34 which border channel 30. Thus, there is no open cavity for dirt or other foreign matter to collect in.

When glass 14 is to be installed in frame 16 in the field, the installer takes frame 16 apart, the glazing strips 50 are removed, inverted, relative to the channel protective position shown in FIG. 4, and immediately snapped back into the channels 30, to provide the glass holding and protective position shown in FIG. 5. Glazing strip 50 defines a minimum inner dimension between the inner surfaces 80 of the first and second leg portions 66 and 68 after it is inserted into the position shown in FIG. 5, which dimension is less than the thickness dimension of glass 14. The glass 14 then tends to straighten the inwardly flexed leg portions 66 and 68 when it is inserted into the glazing strips, forcing the softer barbs 86 and 88 against glass 14, to provide an improved seal between the glazing strips 50 and the glass 14. The extreme ends of leg portions 66 and 68 lie just below lip portions 48 and 49, and thus lip portions 48 and 49 function to maintain glazing strip 50 in the proper position within channel 30 until the perimetrical edges of glass 14 are disposed within the openings of the various channels 30 and associated frame elements.

We claim:

1. A substantially rectangular panel suitable for use in an office space dividing system, comprising:

a frame having a plurality of rails and stiles which cooperatively define a window, said rails and stiles each having an inner facing edge which borders said window, each of said inner facing edges including a longitudinally extending channel, with said channel having a substantially U-shaped cross-sectional configuration which includes a bight and first and second spaced leg portions which define an opening to the channel, said channels cooperatively providing a continuous annular channel about the frame window, a plurality of glazing strips, each of said glazing strips having a substantially U-shaped configuration including a bight and first and second spaced leg portions having extreme ends which define an opening to the glazing strip, each of said glazing strips being dimensioned and configured to provide first and second different functions in first and second selectable orientations thereof relative to an associated channel, with each glazing strip being insertable into a channel in a selected one of said first and second orientations, with the first orientation being an object holding position in which the bight of the glazing strip is adjacent to the bight of the associated leg portions of the glazing strip are adjacent to the opening of the associated channel, and with the second orientation being an object blocking shipping position wherein the glazing strip is inverted, compared with the first orientation, with the extreme ends of the first and second leg portions of a glazing strip being adjacent to the bight of the associated channel, and with the bight of the glazing strip being adjacent to the opening of the associated channel, such that the bight of the glazing strip extends across the opening to the associated channel to prevent foresight matter from entering until such time that the glazing strips are inverted to hold an object inserted into the frame window.

2. The rectangular panel of claim 1 wherein each inner facing edge of the frame defines first and second lip portions which extend inwardly on opposite sides of the associated channel to reduce the width of the channel opening, each glazing strip having a bight which includes a flat outer surface, and including first and second notches respectively disposed at the intersections of the first and second leg portions and bight, each glazing strip being formed of a flexible material and dimensioned such that the glazing strip may be pressed into a channel with an interference fit between said first and second lip portions and the glazing strip, with said first and second lip portions overhanging said first and second notches when the glazing strip is in the second orientation, to maintain the glazing strip within the channel while the flat outer surface of the bight is substantially aligned with the associated edge.

3. The rectangular panel of claim 1 wherein the inner facing edges of the frame include flat surfaces adjacent to their associated channels, and the bight of a glazing strip includes a flat outer surface which is substantially aligned with said flat surfaces of the associated inner facing edge when the glazing strip is in the second orientation.

4. The rectangular panel of claim 3 wherein each inner facing edge of the frame includes first and second lip portions on opposite sides of the associated channel opening, with said first and second lip portions being spaced apart by a predetermined dimension which reduces the width of the opening to the associated channel, and wherein each glazing strip if formed of a flexible material and dimensioned such that the glazing strip may be pressed into a channel with an interference fit between the glazing strip and said first and second lip portions, with said lip portions thereafter functioning to maintain the glazing strip within the channel, in both the first and second orientations of the glazing strip.

5. The rectangular panel of claim 4 wherein the first and second leg portions of each glazing strip are bowed outwardly as they extend away from their associated bight to define an unstressed dimension between their extreme ends which exceeds the predetermined dimension between the first and second lip portions, with the portions of the associated channel, just below the first and second lip portions, in the first orientation of the glazing strip.

6. The rectangular panel of claim 5 wherein the glazing strips are disposed in associated channels in the first orientation of the glazing strips, and including a sheet of material disposed in the window, with said sheet of material having a predetermined thickness dimension and perimetrical edges, said perimetrical edges being disposed in the continuous annular channel, within the openings of the glazing strips and channels, and wherein the outwardly bowed first and second leg portions of a glazing strip define a minimum dimension between the first and second leg portions when the glazing strip is in the first orientation, with the minimum dimension being less than the thickness dimension of the sheet of material, such that the first and second leg portions are stressed by the sheet of material to cause the leg portions to snugly engage the sheet of material.

7. The rectangular panel of claim 6 wherein the extreme ends of the first and second leg portions of each glazing strip include inwardly directed barbs, with the material forming said inward barbs being of softer durometer than the remaining material of the glazing strip, said inward barbs engaging the sheet of material.

* * * * *